United States Patent [19]

Trong

[11] 4,338,908

[45] Jul. 13, 1982

[54] OIL SAVER FOR VEHICLES

[76] Inventor: Ming-Ching Trong, 2nd Fl., No. 63, Lane 194, Sung Chiang Rd., Taipei, Taiwan

[21] Appl. No.: 182,582

[22] Filed: Aug. 29, 1980

[51] Int. Cl.[3] ..... F02M 25/06

[52] U.S. Cl. ..... 123/572; 123/41.86; 123/574

[58] Field of Search ..... 123/572, 573, 574, 41.86

[56] References Cited

U.S. PATENT DOCUMENTS 1,815,623 7/1931 Kamrath ..... 123/574

3,225,753 12/1965 Bintz ..... 123/574

*Primary Examiner*—Ronald H. Lazarus

*Attorney, Agent, or Firm*—Roylance, Abrams, Berdo & Farley

[57] ABSTRACT

This invention discloses an oil saver for vehicles in which a certain amount of fuel-air mixture exhausted out of clearances between piston rings and an inner wall of a cylinder of an automobile can be recovered for reuse. The oil saver comprises an air cleaner, a controlling device communicating with the air cleaner at one end and an intake manifold of the automobile at the other end thereof, and a switching device communicating with a blocking mechanism of the controlling device at one end thereof and a vacuum pipe at the other end thereof.

2 Claims, 2 Drawing Figures

OIL SAVER FOR VEHICLES

This invention relates to an apparatus for saving gasoline to be used in automobiles, and more particularly to an apparatus which can recover a certain amount of fuel-air mixture exhausted out of the clearance between piston rings and an inner wall of a cylinder provided in an automobile and send the exhausted mixture directly into the automobile engine for reuse.

BACKGROUND OF THE INVENTION

Many oil savers for automobiles are known in the art. However, none of them can recover the fuel-air mixture exhausted from clearances between the piston rings and the inner wall of the cylinder.

SUMMARY OF THE INVENTION

In accordance with the invention, an apparatus for recovering fuel-air mixture exhausted out of clearances between piston rings and the inner wall of a cylinder during the compression cycle includes an air cleaner through a pipe connecting with an exhaust hole provided on said cylinder of a known automobile engine, a controlling device having a through way therein for communicating the air cleaner with an intake manifold so as to lead the exhausted fuel-air into the engine, an adjusting screw positioned within the through way for adjusting the flow of the mixture with air, and a blocking mechanism for controlling the communication condition of the through way, and a switching device having a through way therein communicating the blocking mechanism with a vacuum pipe positioned between a carburetor and a distributor, a movable block normally positioned within the through way to close the communication between the blocking mechanism of the controlling device and the vacuum pipe, and an electrical magnet connected through a switch with a battery for controlling the movement of the block. Thus, when one turns on the switch, the movable block will be moved backwards by the electrical magnet to make the through way provided in the switching device keep in a communicable condition, so that the blocking mechanism may be driven by the suction force generated by the vacuum pipe to make the through way provided in the controlling device keep in a communicable condition, and as a result exhausted fuel-air mixture will flow through the air cleaner and the controlling device into the intake manifold. If the ratio of the exhausted mixture of fuel and air does not reach a proper value such as 1:15 which has been deemed the most proper ratio of fuel to air, a certain amount of air will be sucked from the atmosphere through the air cleaner into the intake manifold by the suction force of the engine.

Accordingly, it is a main object of this invention to provide an apparatus which can recover a certain amount of fuel-air mixture exhausted from the clearances between the piston rings and the inner wall of the cylinder and send the exhausted mixture to the intake manifold for reuse.

It is another object of the invention to provide an apparatus which can maintain a proper ratio of fuel to air for the recovered mixture to be sent to the intake manifold.

These and other objects of the invention will be more clearly understood from the following detailed description taken in connection with the accompanying drawings, wherein:

FIG. 1 is a diagrammatic illustration with partial sectional view of the apparatus according to the invention, and FIG. 2 is a perspective diagrammatic illustration of the apparatus with some of the parts mounted in the automobile to illustrate the connection relation therebetween.

DETAILED DESCRIPTION OF THE INVENTION

Figure 1:
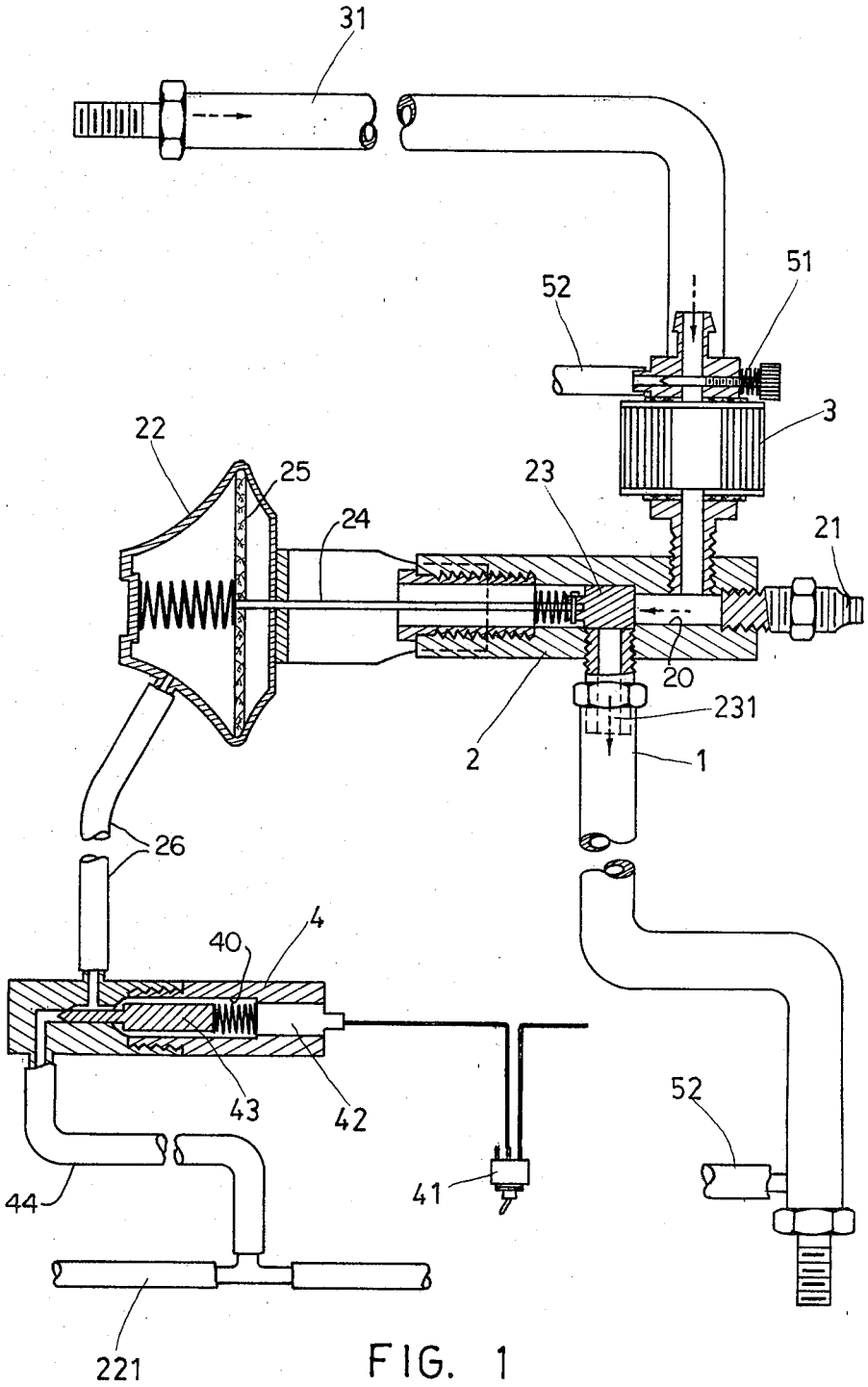

Referring to the drawings and particularly to FIG. 1, there is shown an apparatus in accordance with the invention comprising an air cleaner 3, a controlling device 2 and a switching device 4. through a pipe 31 the air cleaner 3 is connected with an exhaust hole 5 of a cylinder provided in an automobile engine (not shown) so that a certain amount of usually wasted fuel-air mixture exhausted out of clearances between piston rings and the inner wall of the cylinder will flow through the pipe 31 into the air cleaner 3 by the compressed pressure produced by a piston provided in the cylinder. The controlling device 2 is provided with a through way 20 therein whose one end communicates with the air cleaner 3 and the other end communicates through a pipe 1 with an intake manifold 6 of the engine, an adjusting screw 21 positioned within the through way 20 to adjust an opening between the through way 20 and the air cleaner 3, and a movable block 23 connected with a driving rod 24 and having one end thereof mounted on a diaphragm 25 provided in a closed casing 22 so that, when the diaphragm 25 is moved backwards by an external force the block 23 will move a certain distance to open the opening between the through way 20 and the pipe 1 to allow the fuel-air mixture to flow through the pipe 1 into the intake manifold 6.

Figure 2:
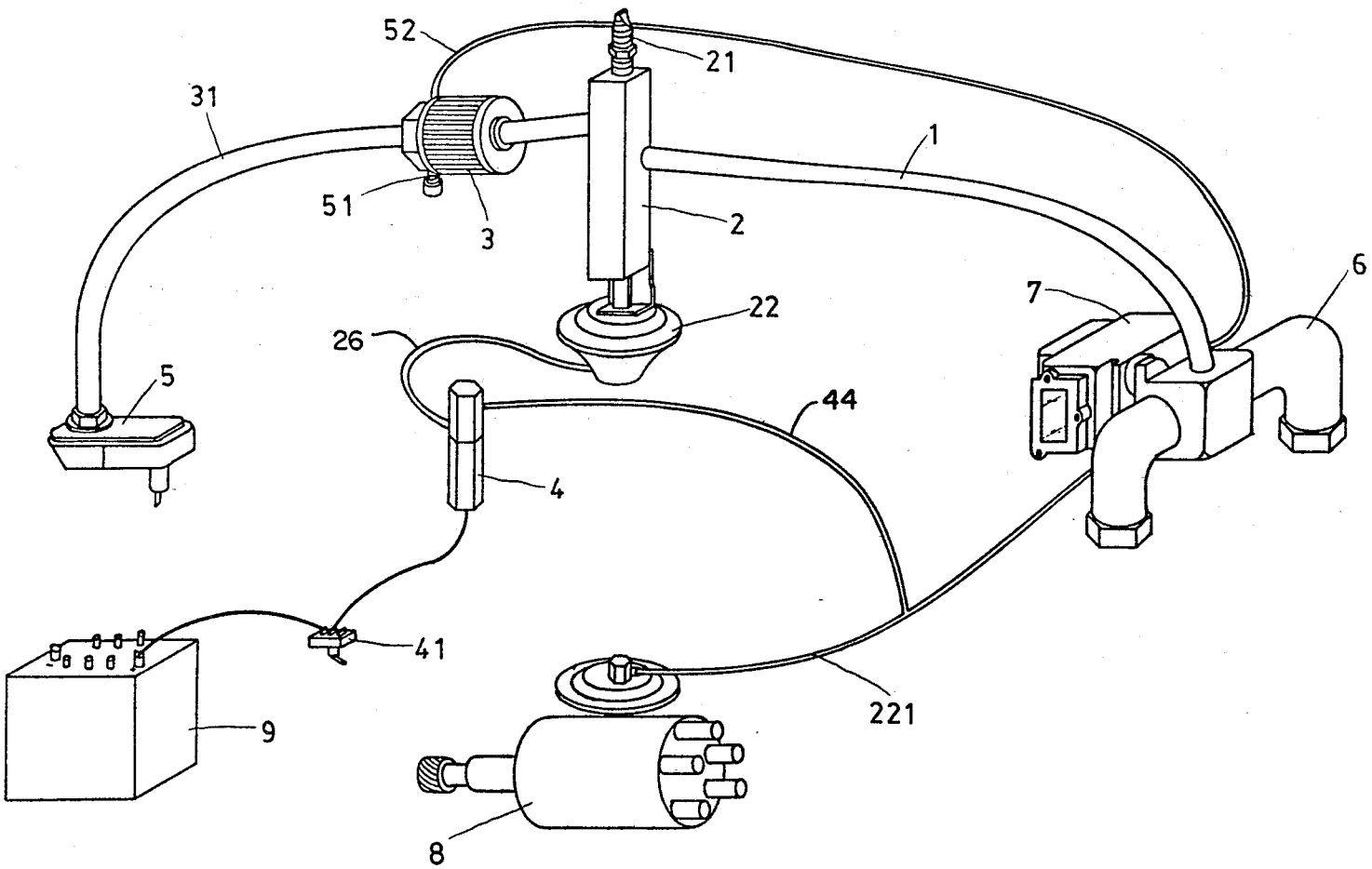

The switching device 4 is also provided with a through way 40 therein whose ends, by means of pipes 26 and 44, are connected respectively with the closed casing 22 and a vacuum pipe 221 connecting a carburetor 7 with a distributor 8 (FIG. 2). A movable block 43 provided in the through way 40 is normally positioned on an opening between the through way 40 and the pipe 26 so as to close the communication therebetween, and controlled by the electrical magnet 42 which is connected through a one-way switch 41 with a battery 9.

Thus, when one turns on the one-way switch 41, the block 43 will be moved backward by the electrical magnet 42 and as a result the suction force of the vacuum pipe 221 will, through the pipe 44N the through way 40 and the pipe 26, attract the diaphragm 25 causing it to move backwards. Under such situation, the block 23 is moved to open the through way 20 so as to allow the exhausted fuel-air mixture to flow into the intake manifold 6. In other words, the block 23 is controlled by the operation of the engine. Since running cycle of the engine depends on the suction force of the vacuum pipe 221, the block 23 may not be moved or may be moved a very short distance due to the suction force of the vacuum pipe is very weak when the engine is operated at a lower running cycle or at an idle running.

If the ratio of fuel to air does not reach a proper value such as 1:15, a suitable amount of air in the atmosphere will freely flow through the air cleaner 3 into the intake manifold 6 by the suction force of the engine.

By screwing the adjusting screw 21 inwards or outwards within the through way 20, a desirable opening between the through way 20 and the air cleaner 3 will be formed so as to control the flow of the exhausted mixture with air.

In order to utilize the exhausted mixture effectively, a pipe 52 is used to connect the air cleaner 3 with the intake manifold 6 directly so that the exhausted mixture with a suitable amount of air may be sent into the intake manifold 6 through the pipe 52 even if the engine is operated at idle running or at a lower running cycle. Similarly, a further adjusting screw 51 is provided on the pipe 52 for controlling the flow of the fuel-air mixture through the pipe 52 into the intake manifold 6.

Obviously, many modifications and variations of the present invention are possible in light of the above disclosure. It is therefore to be understood that within the scope of the appending claims the invention may be practiced other than what has been specifically described.

What is claimed is:

1. An apparatus for recovering a certain amount of fuel-air mixture exhausted out of clearances between piston rings and an inner wall of a cylinder provided in an automobile during compression cycle and sending the recovered mixture into an intake manifold of the automobile engine, which comprises, an air cleaner communicated with an exhaust hole provided on the cylinder, a controlling device having a through way therein whose one end is communicated with said air cleaner and the other end is communicated with the intake manifold of the automobile engine, an adjusting screw positioned within the through way for determining a communicating opening between said air cleaner and the through way, and a movable blocking mechanism partially positioned within the through way for controlling a communicating opening between the through way and the intake manifold, and a switching device having a through way therein whose one end is communicated with the blocking mechanism of said controlling device and the other end is communicated with a vacuum pipe connecting a carburetor with a distributor, and a movable block normally positioned within the through way to close the communication between the vacuum pipe and the blocking mechanism of said controlling device and driven by an electrical magnet which is actuated by a battery and controlled by a switch, whereby when the temperature of the engine reaches a proper value one may turn on the switch to open the through way of said swiching device so that the blocking mechanism of said controlling device can move backwards by a suction force generated by the vacuum pipe to open the communicating opening between the through way of said controlling device and the intake manifold thereby the fuel-air mixture exhausted from the clearances between the piston rings and the inner wall of the cylinder with a certain amount of air from the atmosphere will flow through said air cleaner into the intake manifold for reuse.

2. An apparatus as claimed in claim 1 further comprising a pipe communicating said air cleaner directly with the intake manifold whereby the exhausted fuel-air mixture with a certain amount of air can still be sent into the intake manifold for reuse even if the blocking mechanism of said controlling device closes the through way of said controlling device.

* * * * *